United States Patent [19]

Karls et al.

[11] 3,935,812

[45] Feb. 3, 1976

[54] COMPACTOR

[75] Inventors: Robert F. Karls, Hales Corners; James H. Enright, Racine, both of Wis.

[73] Assignee: Emerson Electric Co., St. Louis, Mo.

[22] Filed: Apr. 23, 1973

[21] Appl. No.: 353,921

Related U.S. Application Data

[62] Division of Ser. No. 177,385, Sept. 2, 1971, Pat. No. 3,772,984.

[52] U.S. Cl. ..... 100/214

[51] Int. Cl.² ..... B30B 1/00

[58] Field of Search ..... 100/229 A, 214, 221, 255, 100/240, 245

[56] References Cited

UNITED STATES PATENTS 3,680,475 8/1972 Gladwin ..... 100/214 X

*Primary Examiner*—Billy J. Wilhite

*Attorney, Agent, or Firm*—Joseph P. House, Jr.

[57] ABSTRACT

A trash compactor with a housing having a head space at its top, a trash container at its bottom and a trash loading space between the head space and the trash container, a trash loading port in the side of the housing aligned with the trash loading space, a pressure platen and a lazy tong or scissors extension linkage mounted at the top of the housing and operable to move the platen between one or more advanced positions in which the extension linkage spans across the trash loading space and the platen is imposing compacting pressure on trash within the container, and a retracted position in which the extension linkage and platen are withdrawn into said head space, thus leaving the intervening trash loading space open for loading trash into the container through said loading port and without having to withdraw the container from the housing for loading purposes.

3 Claims, 32 Drawing Figures

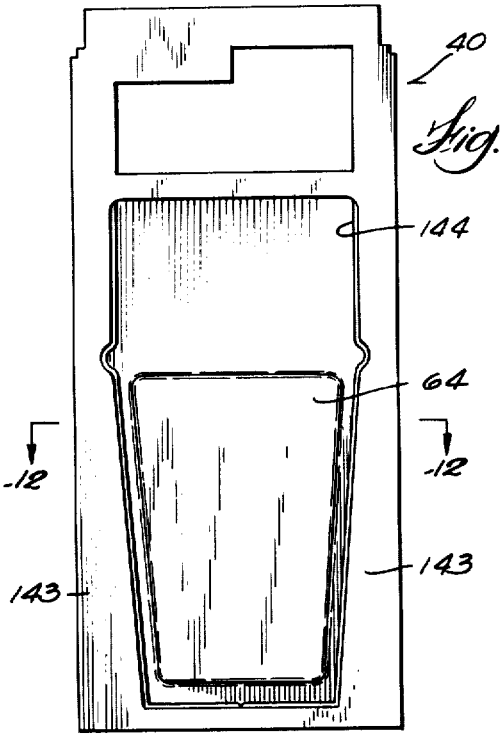
Fig. 11
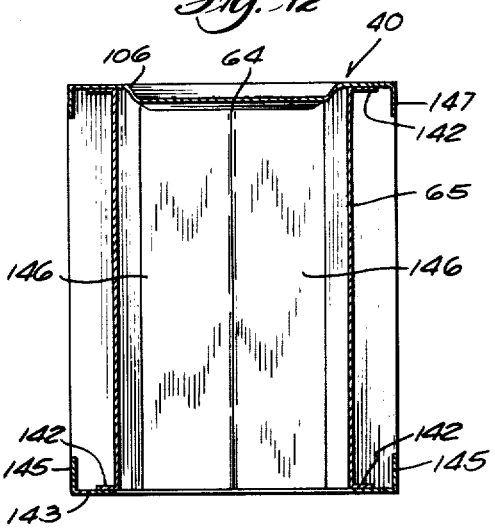
Fig. 12
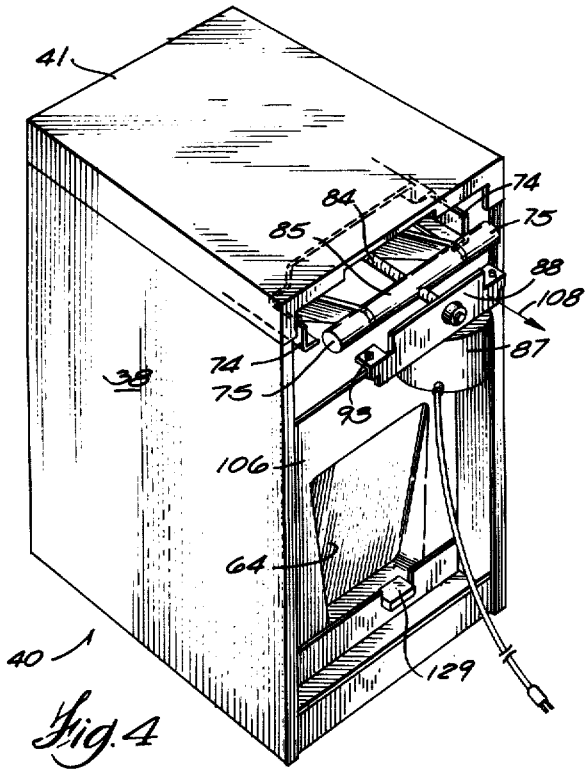
Fig. 4
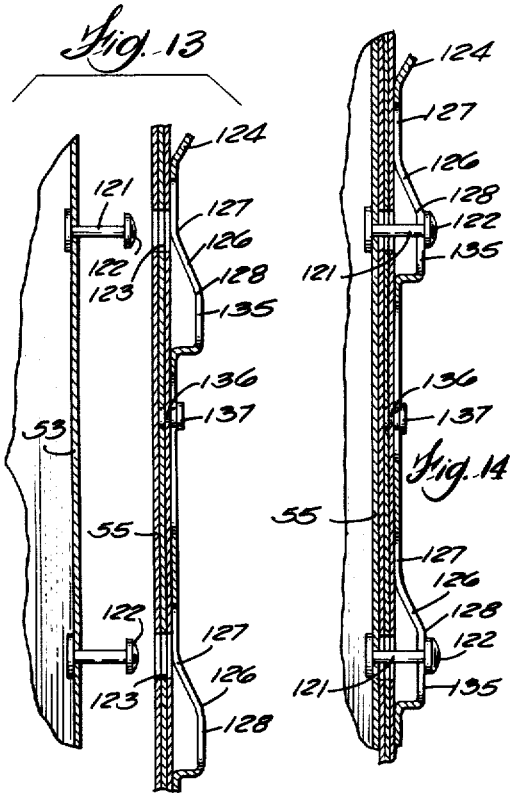
Fig. 13
Fig. 14

Fig. 6
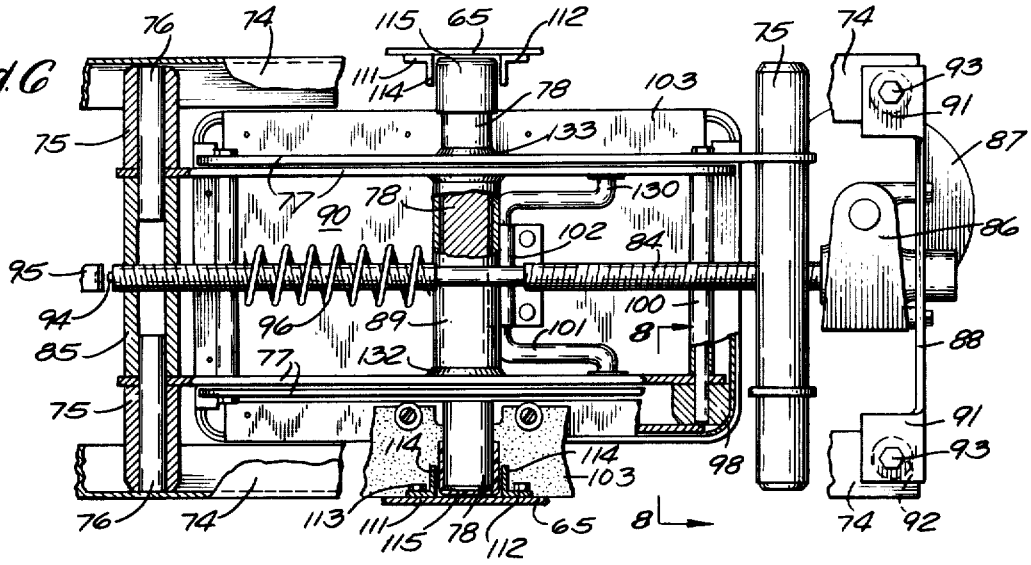
Fig. 7
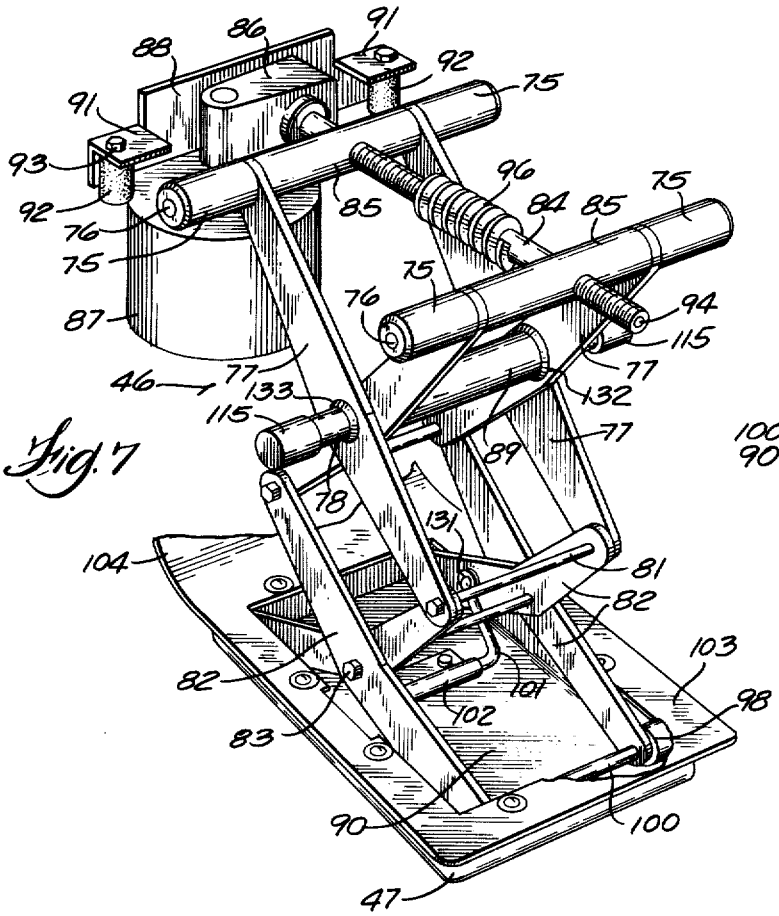
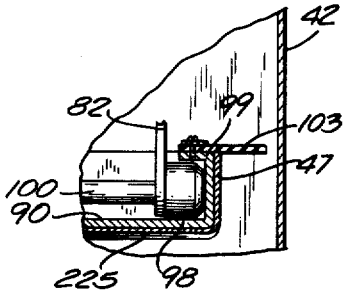
Fig. 8

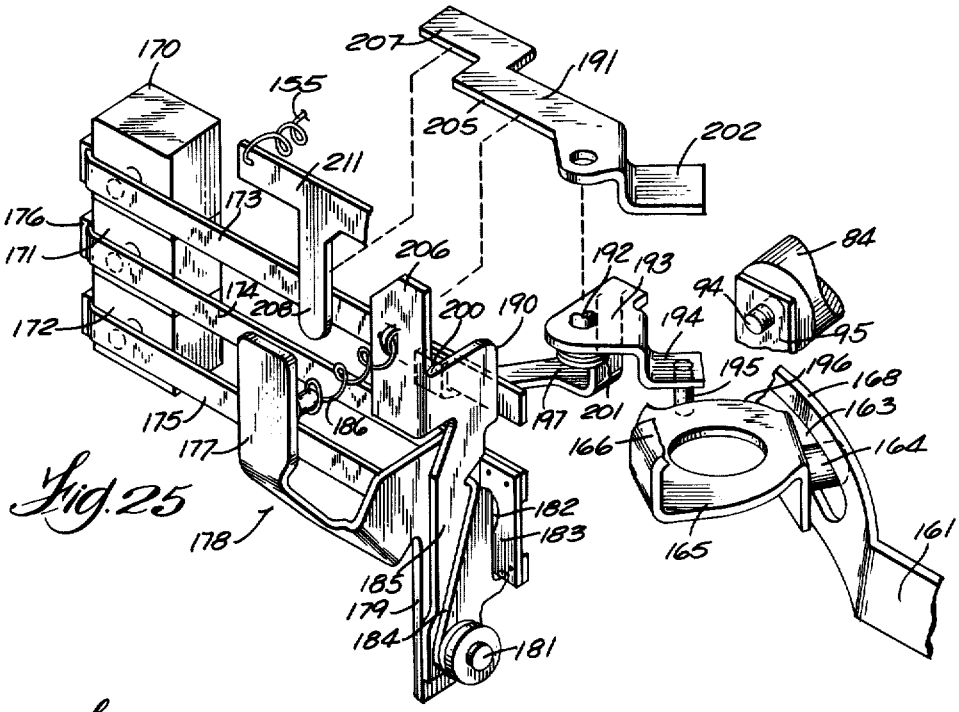
Fig. 25
Fig. 26
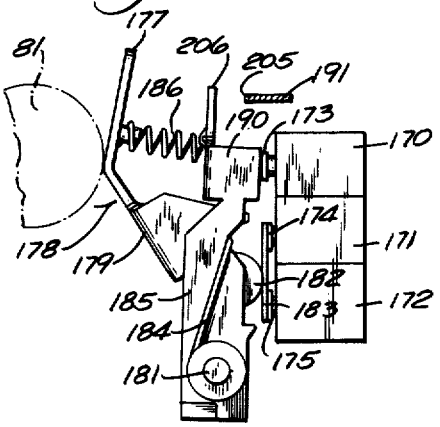
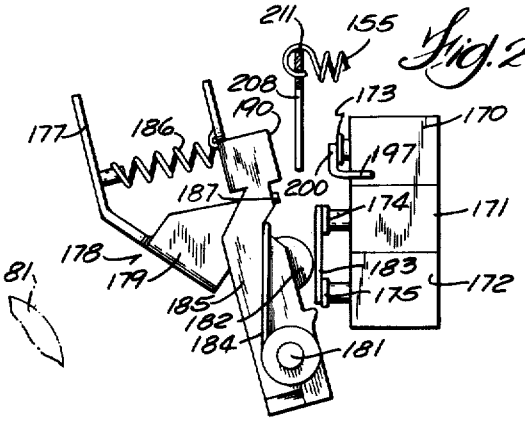
Fig. 28
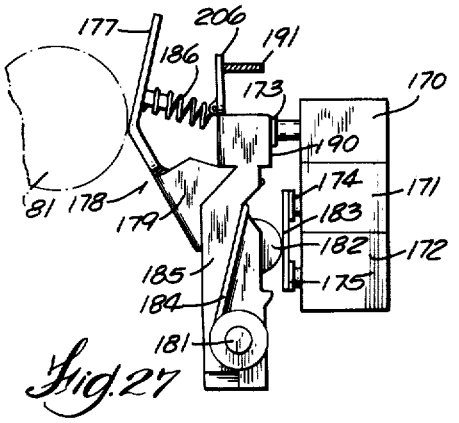
Fig. 27
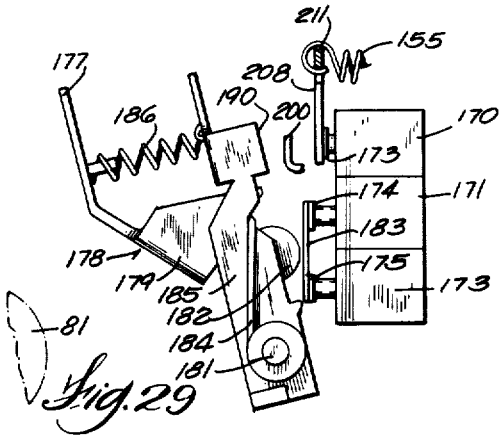
Fig. 29

COMPACTOR

This application is a division of application Ser. No. 177,385, filed Sept. 2, 1971, now U.S. Pat. No. 3,772,984.

BACKGROUND OF THE INVENTION

Commercial and industrial trash compactors have been in use for many years, but only recently have trash compactors of small and compact size and adapted for home use become available. The trash compactor shown in U.S. Pat. No. 3,537,390 is an example of the current state of the art.

SUMMARY OF THE INVENTION

The present invention improves on the prior art in several significant particulars. The typical prior art compactor, as above mentioned, mounts the trash container in a drawer which must be pulled out each time trash is loaded into the compactor. This requires manual exertion which militates against use of the compactor and also creates a problem of supporting the trash container during the compaction cycle.

It is an object of the present invention to eliminate the need for withdrawing the container from the housing during loading and to make the loading operation extremely easy, requiring little or no manual effort. In accordance with the present invention the container remains in the compactor housing in substantially the same position during loading and during the compaction cycle. An easily opened access or loading door is provided which is aligned with a loading or chute space above the container and above which the pressure platen is withdrawn on a lazy tong or scissors extension linkage so as to be withdrawn into a head space above and completely out of the way of loading trash into the container through said door.

It is an important feature of the present invention to mount the pressure platen on a linkage which is capable of substantial extension from its retracted to its advanced position, thus enabling the pressure platen to have movement substantially into the container for compaction purposes but yet leave it free to move upwardly into the head space and clear of the loading or chute space. Accordingly, there is no need to withdraw the container from the housing for loading purposes as there is ample loading space thereabove when the extension linkage is fully retracted.

Additional important objects, features and advantages of the invention include:

1. A single lever control which performs multiple functions in the control and operation of the compactor.
2. A unitized frame and body for the compactor housing making for a "clean" design with no projections or crevices to accumulate dirt.
3. A unitary assembly of the pressure platen, linkage extension and drive means therefor, including a motor, all mounted on a carriage which can be removed as a unit from the compactor housing for service, repair and replacement.
4. A trash container with flexible walls and which is configured for all around support by a similarly configured housing cavity into which it fits. Accordingly, great compacting pressure may be imposed without rupturing the flexible walls of the container.

5. A lazy tong or scissors extension linkage which is provided with torque resisting guide structure to track the linkage and pressure platen on a predetermined vertical path, regardless of the symmetry or asymmetry of the resistance offered by the trash and thus relieving the drive screw and force transmitting mechanism of twisting forces.
6. A switch assembly and electrical circuit integrated with the single lever control and by which the ram motor and door latching mechanism are cycled through an operating cycle.
7. A ram pressure platen which has a surface pattern which intensifies fracturing stress on frangible trash.
8. A trash container basket and bag which are presanitized, thus making it unnecessary to provide any supplemental sanitizing treatment therefor.

Other objects, features and advantages will appear from the detailed disclosure.

DESCRIPTION OF THE DRAWINGS

FIG. 4 is a rear perspective view illustrating the removing of the assembly of pressure platen, extension linkage and motor.

FIG. 6 is a view partly in plan and partly in cross section along the line 6—6 of FIG. 5, certain parts being broken away and shown in section.

FIG. 7 is a perspective view of the pressure platen, extension linkage and motor assembly shown apart from the remainder of the device, parts being broken away.

FIG. 8 is a fragmentary detailed view of the sliding connection of the extension linkage to the pressure platen, this view taken in cross section along the line 8—8 of FIG. 6.

FIG. 11 is a front elevation of the housing shell.

FIG. 12 is a horizontal cross section taken along the line 12—12 of FIG. 11.

FIG. 13 is a detail vertical cross section illustrating the relationship between the co-acting walls of the housing and service door and showing the position of the slide bar latch prior to movement of the latch to lock the door to the housing.

FIG. 14 is a view similar to FIG. 13, but showing the door closed and the slide bar latch actuated to fasten the door to the housing.

FIG. 25 is a fragmentary perspective view of the single lever control switch actuating mechanism.

FIG. 26 is a diagrammatic fragmentary end view of the switch actuating mechanism, illustrating the position of various elements prior to starting the compacting cycle.

FIG. 27 is a similar diagrammatic fragmentary view similar to FIG. 26 and showing the position of the corresponding parts after the single lever control has been moved to start position.

FIG. 28 is a similar diagrammatic fragmentary view similar to FIG. 26 illustrating the position of the corresponding parts part way through the compacting cycle and illustrating the positions of the corresponding parts when the single lever control is moved to stop position.

FIG. 29 is a similar diagrammatic fragmentary view illustrating the position of the corresponding parts during operation of the jam responsive mechanism.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figures 9, 10:
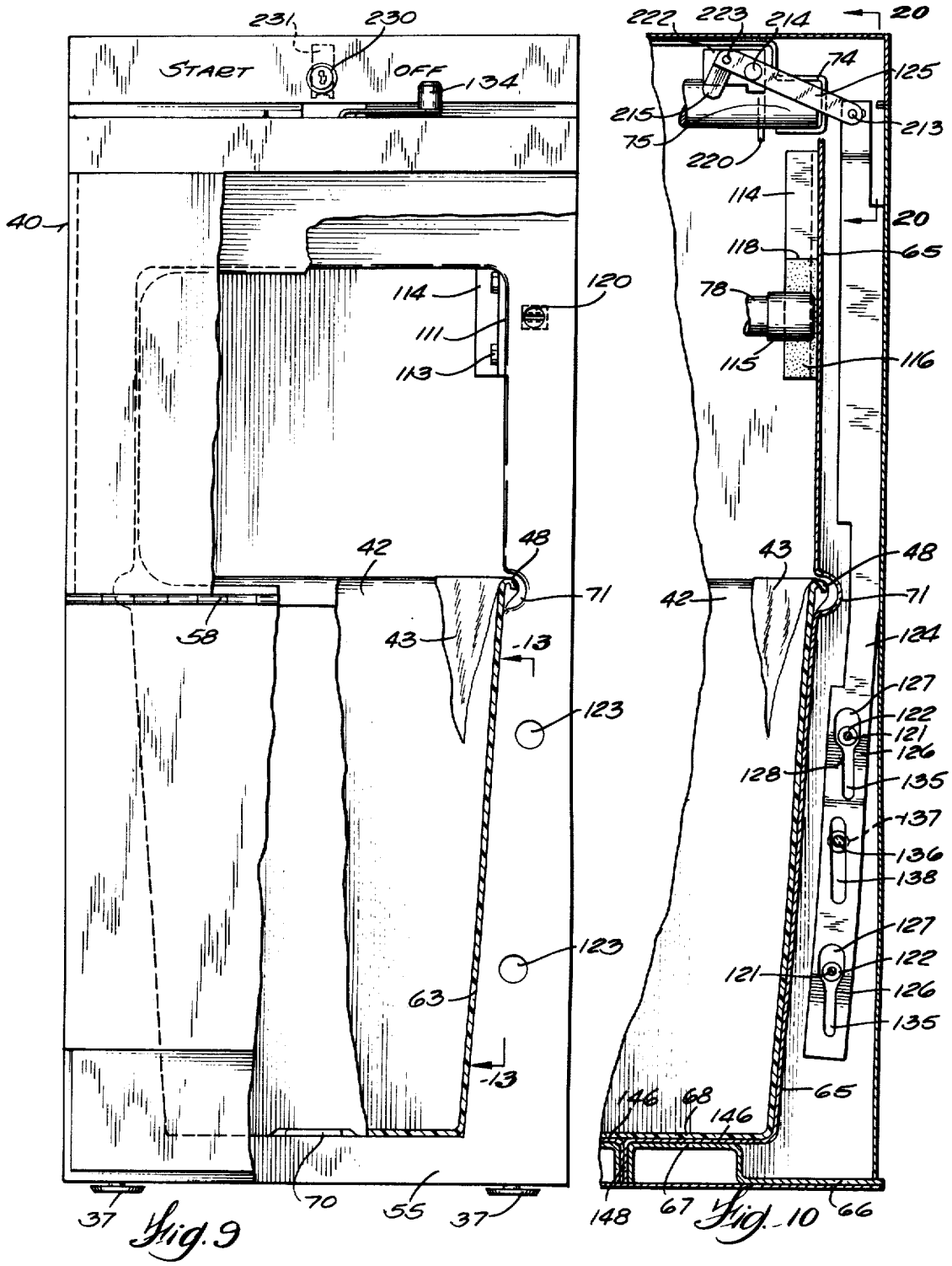
FIG. 9 is a front elevation of the compactor with portions successively broken away to show details thereof.
FIG. 10 is a fragmentary transverse vertical cross section taken through the compactor housing just rearwardly of the housing front wall. A fragment of the extension linkage and its guide track is also shown in this view.
Figure 15:
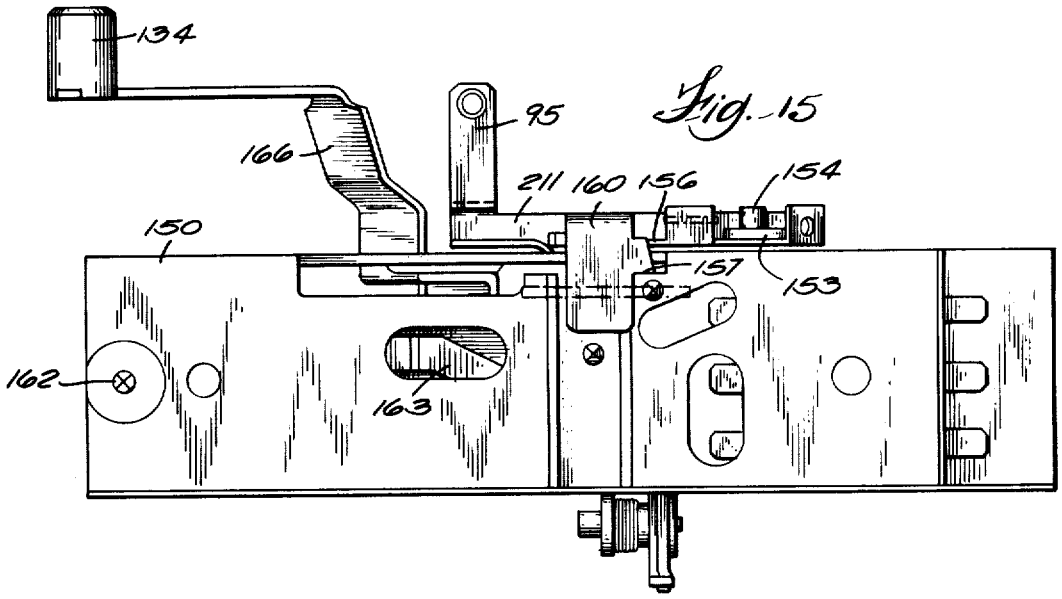
FIG. 15 is a front view of the single lever control assembly.

The compactor includes a housing 40 which is typically about 15 inches wide, 25.5 inches deep and 34.5 inches high, thus to adapt it to fit as a modular unit into a kitchen counter and cabinet assembly. In a free-standing model the housing 40 is surmounted by a top 41 and has a shroud 38 to dress its external surfaces. In a built-in model a portion of a counter in which the compactor interfits substitutes for the top 41. The housing is desirably supported from the floor on adjustable feet 37 (FIG. 9). The compactor may also be located at any other convenient home location, such as laundry room, utility room, closet, basement, garage, covered patio, etc.

Figure 1:
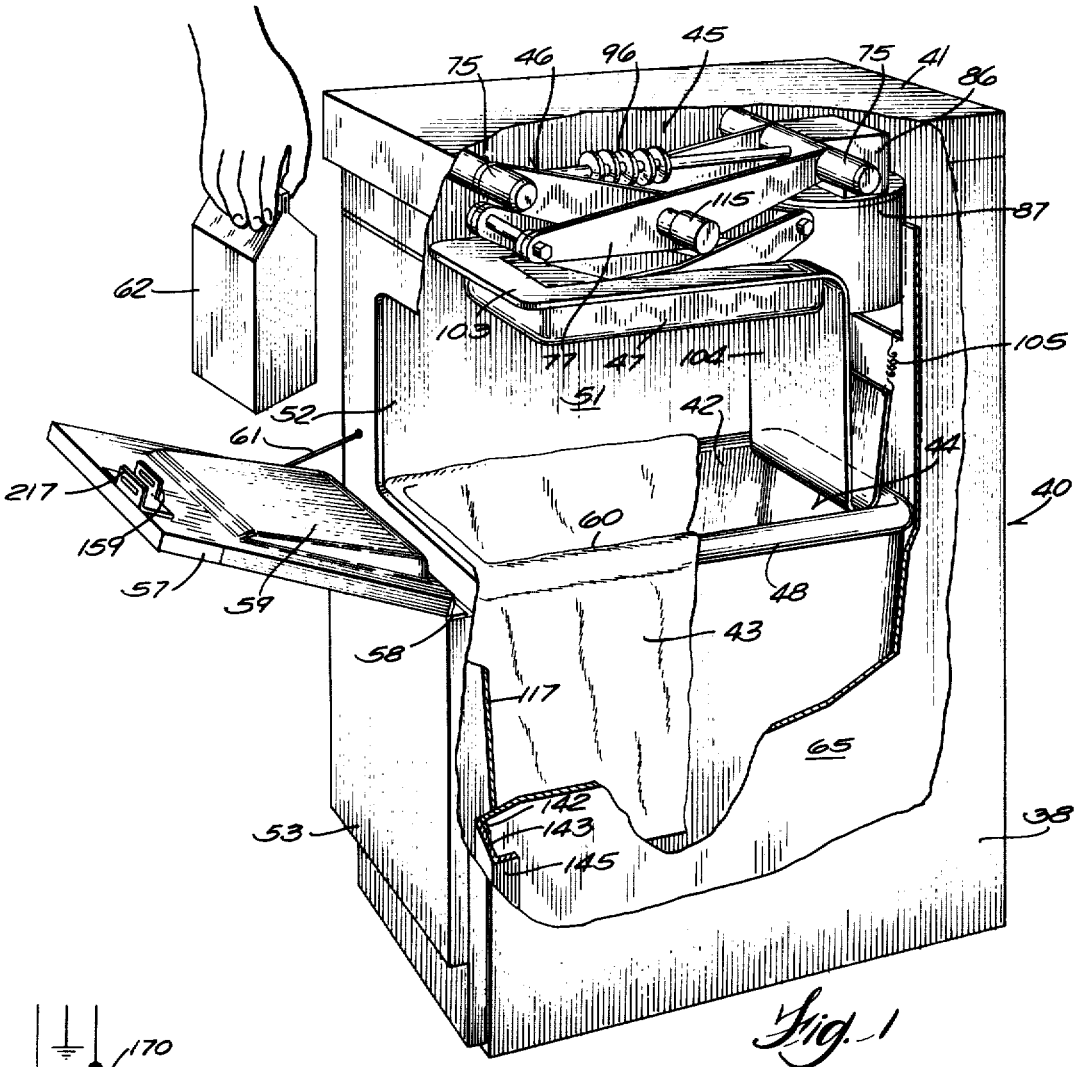
FIG. 1 is a perspective view of a compactor embodying the invention, portions of the housing being broken away to expose the trash basket, pressure platen and scissors or lazy tong extension linkage assembly, the loading door being open to illustrate loading of trash into the basket.
Figure 24:
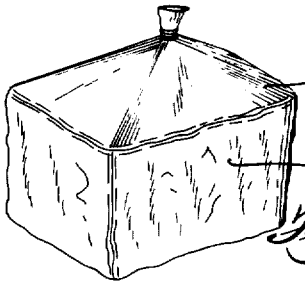
FIG. 24 is a perspective view of a bagged unit of compacted trash, after removal from the basket.

As shown in FIG. 1, the interior of the housing 40 is provided with a cavity 44 for a trash receiving container or basket 42 which has a disposable plastic bag 43 draped into its interior and reverse folded over the outside of the container 42 to provide folding flaps by which the bag 43 may be closed when the container is withdrawn from the housing 40 and the bag is withdrawn from the basket to form a disposable bagged trash unit 39 as shown in FIG. 24. The basket 42 is typically about 16 inches high.

There is a head space 45 within the upper portion of the housing 40 and within which the extension linkage 46 and attached ram or pressure platen 47 are retracted during the "off" or trash loading period of the over-all trash compaction cycle.

Figure 5:
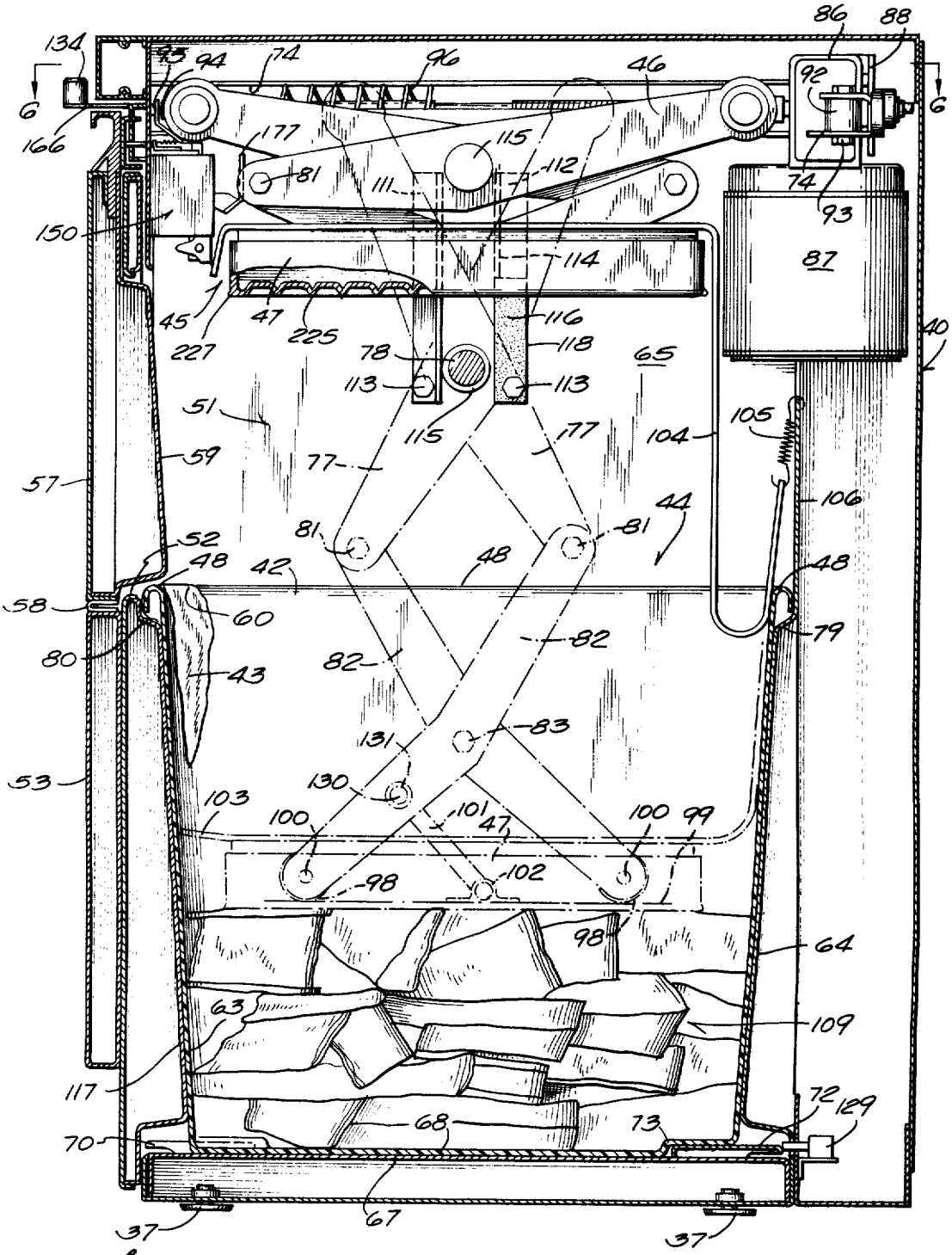
FIG. 5 is a vertical cross section taken through trash compactor embodying the invention, the retracted position of the pressure platen and extension linkage being shown in full lines and advanced position thereof being shown in broken lines.

Scissors-type ram actuating linkages are, of course, old and well known for use in baling presses and the like. U.S. Pat. Nos. 266,967 and 460,009 are typical examples. However, such prior art scissors-type linkages did not employ the multiple or tandem connected scissors linkages characteristic of lazy tong linkages, as herein employed and by which the movement of the ram or pressure platen is greatly extended or magnified in its movement between its retracted position and its advanced position, as is illustrated in FIG. 5.

This capacity of the tandem scissors or lazy tong linkage for great extension is an important advantage in the present invention because it enables the pressure platen to be retracted clear above and in upwardly spaced relation to the basket, thus to permit loading trash into the basket without withdrawing the basket from the housing, in the manner illustrated in FIG. 1.

Scissors linkages are advantageous, because as the scissors links approach parallelism, their mechanical advantage and pressure markedly increase. The greatest resistance to platen movement occurs near the end of the platen advancing stroke where the trash 109 is being compacted (FIG. 5). The platen 47 moves relatively slowly near the end of its advancing stroke at the time when the extension linkages exert their greatest pressure at the greatest mechanical advantage. The extension linkages move relatively quickly near the top of the housing when the platen is under no load, speed of movement being desirable in this part of the cycle.

In a practical embodiment of the invention, the extension linkages and platen assembly will occupy a space of about 6 inches when retracted and will extend to a distance of about 26 inches, for a throw of about 20 inches. The available pressing force of ram platen 47 varies from about 6 hundred pounds at full retracted height to about 35 hundred pounds at full extension. The total time cycle of the ram is about 70 seconds. This time cycle shortens as the basket fills.

There is a substantial space of approximately 8 or 9 inches between the upper rim 48 of the basket 42 and the pressure platen 47 when the pressure platen is fully retracted, as shown in FIG. 1, such space being denominated herein as the trash loading or chuting space 51. Space 51 aligns with the loading port 52 in service door 53. Service door 53 is hinged to the housing 40 on vertical hinges 54 along one corner of the housing 40.

Figure 2:
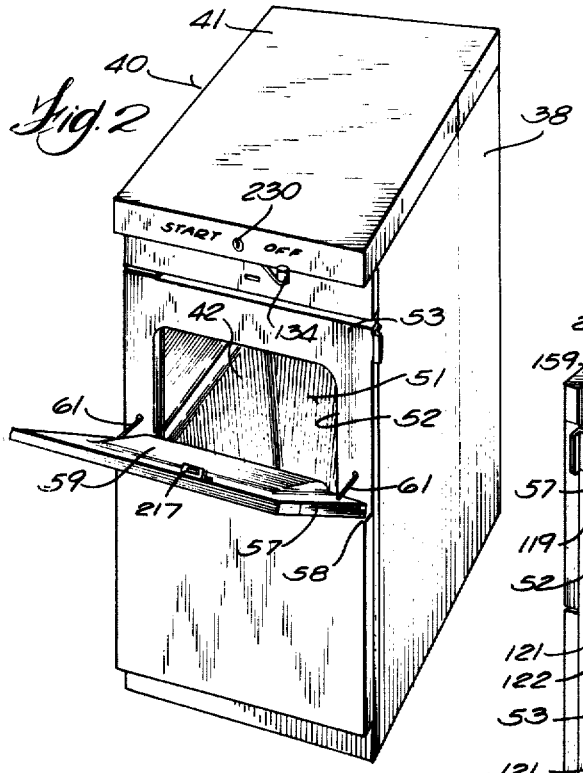
FIG. 2 is a perspective view on a reduced scale of the trash compactor with its loading door open.
Figure 3:
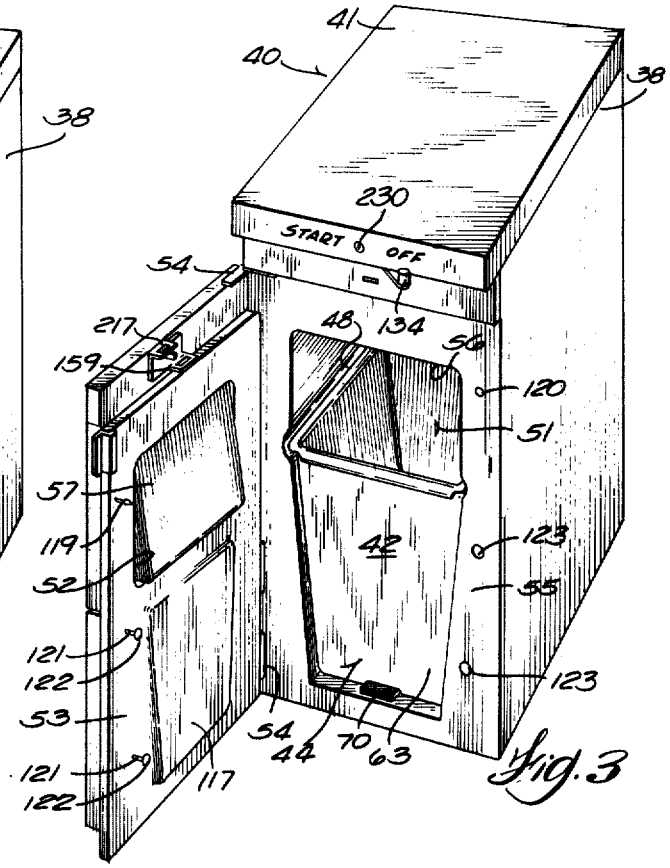
FIG. 3 is a perspective view similar to FIG.2, showing the service door open and the loading door closed.

Accordingly, service door 53 can be swung from its closed position shown in FIG. 2 to its open position shown in FIG. 3, thus to expose the front face 55 of the housing 40 which has a cutout or opening 56 through which the container 42 is loaded into the housing cavity 44 and removed therefrom.

Service door 53 carries a loading door 57 which is pivotally attached to the service door 53 on a horizontal hinge 58, to be swung to its open position shown in FIGS. 1 and 2 and its closed position shown in FIGS. 3 and 5. Conventional retainer cables 61 are spring biased to hold the loading door 57 in its normally closed position and will stop and support the door in its inclined position as shown in FIGS. 1 and 2 during loading of trash 62 through the door opening 52 (FIG. 1). The trash 62 passes through the loading or chute space 51 within the housing en route to the basket 42. The only manual effort required of the housewife is to pull the door 57 about its hinges 58 to its inclined position, against the light tension of the springs connected to the cables 61.

Loading door 57 is provided with an inwardly formed sloping panel or ramp 59 which, in the closed position of the doors as shown in FIG. 5 overhangs the rim 48 of basket 42. Accordingly, any trash which is not completely loaded into the basket 42 and which tends to overhang the front edge 48 thereof, will be pushed into the basket as the door 57 closes. Moreover, as ram platen 47 descends the incline of panel ramp 59 will guide trash which is piled up above the level of rim 48 into the basket and will prevent it from spilling over the front edge of the basket.

Typically, any and all types of household trash will be accepted by the compactor, whether the trash be paper, glass bottles, metal cans, etc. Compacted trash is shown diagrammatically at 109 in FIG. 5.

The plastic basket 42 has downwardly tapering flexible walls 63 on all sides. These flexible walls 63 are supported in the seated position of the basket by rigid re-enforcing or support walls of the housing 40. For this purpose the rear wall of housing 40 is provided with a downwardly and inwardly inclined panel 64 (FIG. 5) and the housing side walls 65 (FIG. 10) are similarly downwardly and inwardly inclined, thus to support the downwardly tapered flexible side walls 63 of basket 42 against ram pressure. Service door 53 is provided with an inclined panel 117 which supports the front wall of basket 42.

The bottom wall 66 of the housing (FIG. 10) has upwardly embossed portions 67 providing a support floor for the bottom 68 of the basket 42.

Housing side walls 65 are provided with an outwardly deformed fold or groove 71 within which the outwardly flanged rim 48 on the basket 42 interfits. Housing rear wall panel 64 is similarly offset at 79 (FIG. 5) and door panel 117 is similarly offset at 80 (FIG. 5) to provide a peripheral seat for basket rim flange 48. When basket 42 is properly received with its rim 48 thus seated, its flexible walls will be supported by the housing and door panels, and a switch actuator 72 within a recess 73 in its bottom wall 68 will engage a basket safety switch 129 which is part of the electric circuit as hereinafter described. The front of basket 42 is also provided with a projecting tab 70. Tabs 70, 72 can be used as bottom handles when inverting the basket 42 to remove the closed, filled bag 43. Alternatively, the operator can step on the tabs 70, 72 to anchor the basket 42 against movement if the filled bag 43 is lifted manually out of the basket.

When bag 43 is fitted into the basket 42 the surplus bag material is reverse folded over the outside of the basket (FIG. 1). Thus this reverse folded bag material is clamped between the basket and housing and door panels 63, 64, 117 under pressure of the basket 42. The bag fold 60 is snubbed about the basket rim 48 and the reverse folded bag material will not be pulled into the basket even though the pressure of the ram on the trash 109 tends to drag the bag into the basket.

The assembly ram unit of extension links 46 and pressure platen 57 is mounted within the head space 45 at the top of the housing 40 on tracks 74 which run fore and aft of the housing 40. Tracks 74 support and guide a carriage comprising four rollers 75 mounted respectively on the ends of the pintles 76 at the upper ends of the upper scissors links 77 of lazy tong or extension linkage 46. There are two spaced parallel sets of scissors linkages 77 interpivoted on a cross pintle 78.

The ends of the scissors links 77 opposite pintles 76 are pivotally connected by pintles 81 to succeeding or tandem sets of scissors links 82, likewise arranged in parallel. Links 82 have their mid points pivotally connected on pintle 83. The far ends of said scissors links 82 are slidably connected to the pressure platen 47, as hereinafter described.

The lazy tongs or extension linkage 46 is actuated by a double reverse pitch lead screw 84 threadedly engaged in spacer tubes 85 which provide bearings for the pintles 76 of the upper scissors linkage 77, which maintain the parallel sets of scissors links 77 in spaced relation and which provides nuts for the screw 84. One end of the lead screw 84 is connected through suitable gearing in the gear box 86 to an electric motor 87. Gear box 86 is fastened to a mounting arrangement including an end plate 88 which has out-turned flange brackets 91 which carry rubber bushings 92 and bolts 93 by which the plate 88 and suspended motor 87 are releasably attached to the aft ends of the track 74 (FIG. 5). The bushings 92 isolate motor vibration from the compactor and provide limited yieldability of the ram assembly in a fore and aft direction.

Accordingly, the extension linkage 46 is mounted in position so that in fully retracted position, as shown in FIG. 5, a contact button 94 on the far end of lead screw 84 will make contact with a switch actuator 95 of the control assembly as hereinafter explained.

A spring 96 coiled about the lead screw 84 will bear against the spacer tubes 85 when the extension linkage 46 is in its fully extended position as shown in broken lines in FIG. 5, thus to provide resistance to further extension of the linkage, in the event of insufficient trash in basket 42, and cushion the end of the lazy tong extension movement. The load thus added to motor 87 will cause the motor to slow down and centrifugal switch 97 in the motor circuit will reverse the motor 87 and withdraw the ram platen 47 from the basket 42. The aforedescribed structure, in which the extension linkage 46 is driven from one end, is advantageous because the lead screw 84, motor 87, gear box 86, etc., have a substantially fixed position during actuation of the extension linkages 46. While it would be possible to drive the linkages from points which must move vertically during expansion and retraction of the linkages, such an arrangement would require complementary movement of the motor, drive screw, etc., and is less desirable for that reason.

The uppermost sets of spaced parallel scissors linkages 77 are interconnected by torque arms or tubes 78, 89 in a unique manner. Spacer or torque arm or tube 89 is rigidly connected by welds 132 to the inside faces of the innermost links 77. Tube 89 is hollow. Torque arm or tube 78 extends through the hollow of tube 89, to turn thereon, and is welded near both ends at 133 to the outer faces of the outermost links 77.

The respective torque tubes or arms 78, 89 transmit unbalanced forces between corresponding links at opposite sides of the scissors extension mechanism to keep the links in alignment and prevent cocking of the spacer nuts 85. Accordingly, twisting forces are balanced by the torque tubes or arms 78, 89 and relieve the screw 84 thereof.

As best shown in FIGS. 5, 6, 7 and 8, the lower ends of scissors links 82 are provided with wheels 98 at the ends of axles 100. The wheels 98 ride or slide freely on tracks 99 formed on the edges of a plate 90 to which the pan-shaped pressure platen 47 is releasably attached. The plate 90 and platen 47 are linked to extension linkage by a U-shaped link 101 which has a bight portion pivotally connected to the plate 90 in a tubular eye 102 and has out-turned ends 130 pivotally connected to the links 82 in bearing apertures 131.

Wheels 98 and the parallelogram motion of the extension linkage 46 keep the platen 47 horizontal. Link 101 keeps the platen 47 substantially centered in basket 42.

Platen 47 is desirably provided around its periphery with a rubber sealing flap 103, the rear end of which is formed as a flexible apron 104 connected by means of a series of small springs 105 to a rear wall panel 106 of the housing 40. As shown in FIG. 5, the apron 104 will drape itself into the basket 42 as the platen 47 descends, thus preventing trash in the basket from climbing out of the basket and overflowing its rim 48. Moreover, the rubber seal 103 acts as a wiper to wipe down the sides of the basket and keep the trash therein as the pressure platen 47 enters the basket.

The fore and aft tracks 74 at the top of the housing 40 provide a convenient means of mounting the extension linkage 46 and provide guide ways for expanding and contracting the linkages on a vertical path as the lead screw 84 turns in forward and reverse direction. The tracks 74 also provide a convenient means for completely removing the unitary motor-operated assembly of extension links 46, pressure platen 47, motor 87, gear box 86, etc., from the housing 40, as is illustrated in FIG. 4. This facilitates maintenance, repair and replacement of the unit. The back of housing 40 is open. When in its fully retracted position the foregoing unitary assembly can be removed in the direction of arrow 108 (FIG. 4) when the attaching bolts 93 are detached from track 74, and guides 112 are removed.

The opposite side walls 65 of the housing 40 are desirably provided with vertically extending metal angle iron guides 111, 112 (FIGS. 5, 9 and 10) which are adjustably mounted on bolts 113 and which provide facing guide channel flanges 114 between which the torque arms 78 of the extension linkage 46 rides vertically for at least a portion of its vertical movement. Torque arm 78 is desirably provided with end wear caps 115 which ride against the channel flanges 114. The extension linkage 46 moves on a vertical path on which the pressure platen 47 is centered in the basket 42 by reason of the drive mechanism in which the lead screw 84 concurrently drives the nuts 85 concurrently toward and away from each other, the path of movement of pintles 78 and 83 remaining on the same vertical axis. Guides 111, 112 function to absorb forward and rearward thrust in the event the reaction pressure of trash tends to move the platen off course.

As best shown in FIG. 5, the rearmost pair of channel flanges 114 are relieved at 118 and rubber or other yieldable blocks 116 are inserted in the recess 118. The blocks 116 are positioned to be engaged by the caps 115 of torque arm 78 just as the platen 47 enters the basket 42. Accordingly, if a hard, unyielding object is wedged between the front of the basket and the platen 47, pressure is exerted to tend to force the platen 47 and extension linkage 46 toward the rear of the housing 40. The yieldable blocks 116 and yieldable bushings 92 permit slight rearward movement of the linkage. Thus the lead screw 84 will back away slightly from contact of its button 94 with switch actuator arm 95 and will actuate the motor control to stop the motor. The operator may now actuate control lever 134 to restart the motor in reverse, thus to cause the platen to retract and relieve the system of the jam, as hereinafter explained. The aforedescribed structure functions as a jam sensor.

As previously indicated, the basket 42 has its flexible plastic side walls supported by correspondingly shaped panel walls in the housing 40. The opening 56 (FIG. 3) in front panel 55 would leave the front wall 63 of the basket 42 unsupported, except for the fact that in accordance with the present invention the service door 53 is provided with an appropriately shaped downardly and inwardly inclined pressure support panel 117 which supports the wall 63 of the basket 42 (FIG. 5).

To securely latch the service door 53 to the housing 40 when it is closed and thus insure adequate support for the basket 42 and also to insure against service door 53 opening once the compacting cycle has started, a novel latching mechanism, as shown in FIGS. 3, 9, 10, 13 and 14, is provided. Service door 53 is provided with vertically spaced, inwardly projecting pegs 121 having enlarged heads 122. The housing front panel 55 and adjacent frame parts are provided with aligned openings 123 large enough to receive the heads 122 (FIGS. 13, 14). Behind the panel 55 and adjacent frame parts is a vertically slidable latch bar 124 (FIG. 10), the upper end of which is pivotally connected on pin 213 to the crank arm 125 of actuating mechanism which functions as hereinafter explained. Latch bar 124 is provided with inclined cam portions 126 (FIGS. 13, 14), each one of which is provided with a keyhole slot having an enlarged head portion 127 and a narrow neck portion 128.

The heads 122 of the pins 121 on door 53 are received through the apertures 123 on the panel 55 and through the enlarged head portions 127 of the latch bar 124 when the door 53 is closed. At the same time, a headed pin 119 engages a spring biased detent socket 120 (FIG. 3) to hold the door 53 closed pending actuation of the latch slide bar 124.

When the single lever 134 of the compactor control is actuated as hereinafter described, the crank arm 125 will be actuated to lift the latch bar 124 and press its cams 126 against the undersurface of pin heads 122, thus to clamp the service door 53 against the panel 55, as is shown in FIG. 14. The inclined cam portions 126 of the latch bar 124 merge into vertical bar portions 135 which include the tail ends of narrow slots 128 and which align with the pins 121 in the latched position of door 53.

In order to guide movement of latch bar 124, panel 55 is provided with guide pins 136 which have heads 137 which overlap guide slots 138 on the latch bar 124, as shown in FIG. 10.

The housing 40 is uniquely formed with a unitary frame and body, substantially free of crevices and cracks within which bacteria, dirt, etc., can lodge. The unitized frame and body is inherently strong, simplifies fabrication and reduces fabrication expense.

As best shown in FIGS. 11 and 12, the side wall panels 65 of the housing have out-turned edge flanges 142 by which the panel edges are stiffened. Structural front panel 143, which is cut out at 144 to match cutout 56 in face panel 55 (FIG. 3) has edge flanges 145 turned at a 90 degree angle to flanges 142. Rear panel 106 is similarly provided with turned flanges 147.

Flanges 142 are fastened or joined mechanically in face relation to front panel 143 and rear panel 106, as by welding, riveting, bolting, etc., thus to unitize the front, side and rear panels, with the flanges 142, 145, 147 forming box section corner posts rigidly supporting the housing 40 with no need for any other form of frame. The side walls 65 of housing 40 are turned inwardly to form floor panels 146 beneath the basket 42 (FIGS. 10 and 12), and are turned downwardly to form abutting flanges 148 similarly fastened or joined in face relation.

Thus the surfaces within the housing are broad and smooth without cracks, crevices, interior bolts, etc., which would otherwise trap dirt and bacteria.

The single lever control switching mechanism and circuit diagram are shown in FIGS. 15 through 30, inclusive. Control and switching mechanism is housed in a control box 150 (FIGS. 5 and 9) at the upper front corner of the housing 40. The single control lever 134 on arm 166 projects forwardly of the housing 40 in an easily accessible position. Control lever 134 is actuated manually by the operator through a cycle in which various functions are automatically coordinated for safe and convenient operation of the compactor.

An important safety feature requires that both the service door 53 and the trash loading door 57 be closed before the single lever 134 can be moved from its "off" position at the right of the housing to its "start" position at the left of the housing, as shown in FIGS. 2, 3 and 9. For this purpose the loading door 57 is provided with a striker 151 (FIGS. 16, 19) which is aligned to engage tab 152 of a rotary bracket 153 which is pivotally mounted on pintle 154 and is biased by spring 155 to project the tab 152 forwardly of the housing 40 and into the path of striker 151 of loading door 57.

When in its forward position a latch finger 156 on the swing bracket 153 engages beneath ledge 157 (FIGS. 15, 16) on latch bolt 160 to prevent downward movement of bolt 160 and hence prevent any substantial movement of the lever 134 away from its off position. The latch bolt 160 is mechanically connected to lever 134 so that blockage of movement of bolt 160 also blocks movement of lever 134. However, when both the service door 53 and loading door 57 have been closed, the striker 151 moves the swing bracket 153 rearwardly to its position shown in FIG. 16, thus withdrawing the finger 156 from obstructing downward movement of the bolt 160 and its interconnected lever 134. Accordingly, lever 134 may then be swung to its "start" position at the left of the cabinet, in which position it is shown in each of FIGS. 15, 16 and 18.

Figure 19:
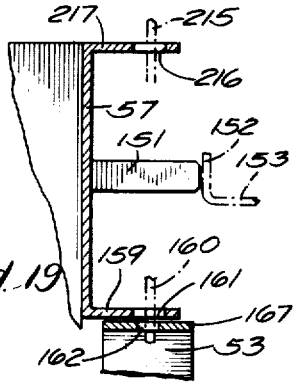
FIG. 19 is a fragmentary vertical cross section taken through the service and loading doors and illustrating the latching operation.

In the course of its movement from "off" to "start", lever 134 will function to operate the latch bolt 160 which will move downwardly to engage through a bolt opening 161 in a flange 159 of loading door 57 (FIG. 19). Bolt 160 concurrently engages through a bolt opening 162 in a flange 167 of service door 53 (FIG. 19), thus to positively latch both loading and service doors in closed position, prior to the starting of the compacting cycle.

Latch 160 is moved in response to movement of a swing arm 161 (FIGS. 16, 18 and 25) which is swingable about pintle 162 at one end of the box 150. Arm 161 has a curved portion 168 about the axis of pintle 169, and a contained inclined cam follower slot 163 (FIGS. 15, 16, 18 and 25) in which rides a cam trunnion 164 mounted on a rotor bracket 165 from which arm 166 for single lever 134 projects. Brackets 165 turns on the axis of pintle 169. Accordingly, as lever 134 swings, it will cause the trunnion 164 to sweep through an arc including the inclined cam follower slot 163 in the swing arm 161 and thus raise and lower the arm 161 about its pintle 162.

Figure 16:
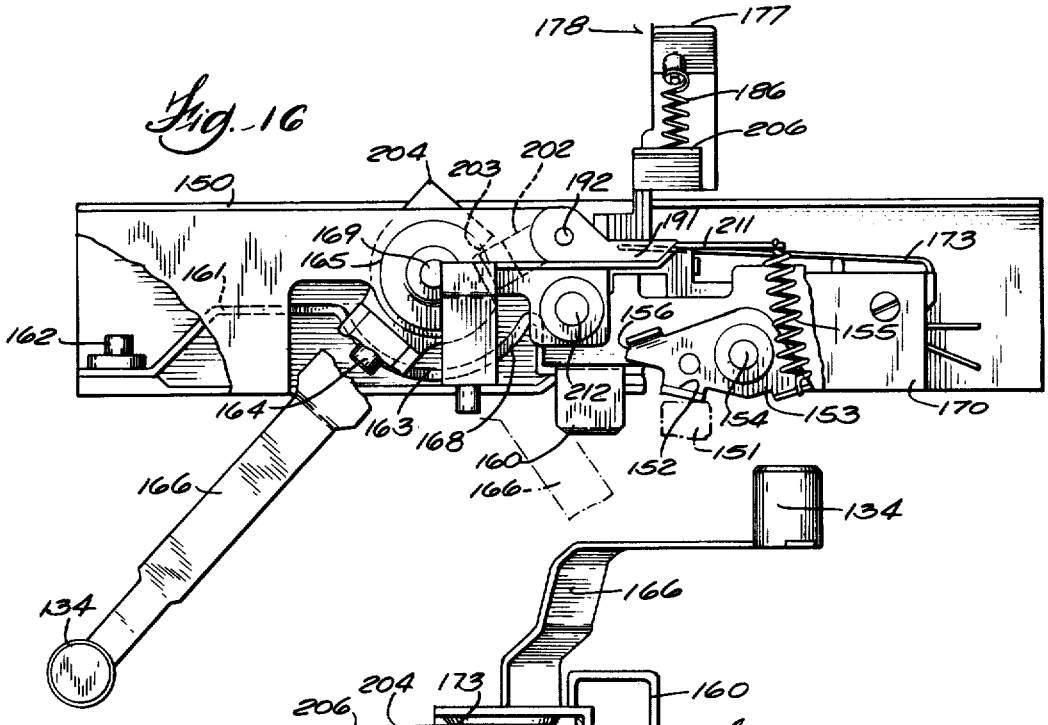
FIG. 16 is a top view of the single lever control assembly.
Figure 17:
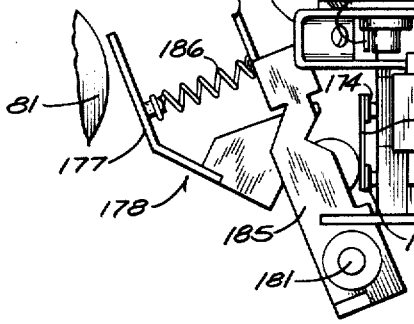
FIG. 17 is an end view of the single lever control assembly.

In moving from its broken line position of FIG. 16 (off position) to its full line position (start position), the arm 166 for lever 134 will function to swing the latch bolt 160 downwardly into latching engagement with the latch apertures 161, 162 as shown in FIG. 19 aforesaid, provided however that the interlock swing bracket 153 has first swung inwardly against the bias of its spring 155, as aforestated.

In this manner the single control lever 134 functions to lock both the loading door 57 and the service door 53 before reaching its "start" position. Moreover, unless the doors 53, 57 are closed, the control lever 134 cannot even be moved toward initiation of the compacting cycle.

Conversely, when the compacting cycle is finished and the control lever 134 and arm 166 are swung from full to broken line positions shown in FIG. 16, latch finger 160 will be lifted as a consequence of upward pivotal movement of the arm 161, thus to withdraw the finger 160 from the latch holes 161, 162 and will permit both doors 53, 57 to be opened. As soon as pressure of the striker 151 is withdrawn from tab 152, spring 155 will pivot latch bracket 153 to a position where its stop detent 156 is in the path of downward movement of bolt ledge 157, thus preventing any further actuation of the lever 134 until the doors are again closed.

Figure 30:
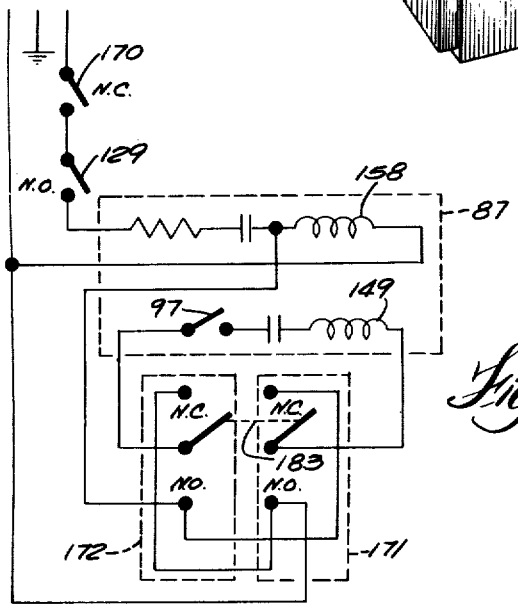
FIg. 30 is a simplified electric circuit diagram for the motor controller.

Control box 150 contains switches for actuating the motor 87 in a cycle which includes several additional interlocks and safety features. The motor circuit is indicated in FIG. 30. The motor start-stop switch 170 and paired reversing switches 171, 172 typically comprise microswitches having actuating buttons respectively actuated by leaf blades or arms 173, 174, 175, each of which is anchored at corresponding ends upon a block 176 (FIG. 25).

The actuating buttons of switches 170, 171 and 172 are internally spring biased to project the buttons outwardly, in which position the switches are normally closed or normally open, as indicated in FIG. 30. The leaf arms 173, 174, 175 can be actuated to press the buttons inwardly against their spring bias, in which event the respective switches will be thrown to their opposite positions. When the leaf arms 173, 174, 175 are actuated to release pressure on the buttons, they will return to their normal positions.

The leaf arms 173, 174, 175 are subject to the pressure of several levers, tabs, etc., which respond to various forces all of which are integrated and inter-related to produce the desired sequential actuation of the switches 170, 171, 172 for proper operation of the motor 87 and for safety reasons. Fundamentally, motor 87 will be energized whenever the pressure of leaf arm 173 is relieved from the actuating button of the start-stop switch 170. Switch 170 will then move to its normally closed position and energize the motor circuit, assuming however that basket switch 129 is also closed.

Moreover, the centrifugally actuated motor start switch 97 must also be closed to start the motor 87 through its start winding 149. Switch 97 will normally be closed when the motor is at rest or whenever the motor slows down from its normal running speed as a consequence of the imposition of heavy loads thereon. When running at normal running speeds the conventional centrifugal actuator therefore will cause switch 97 to open. However, this will not stop the motor which will then be energized directly through its main winding 158. Motor 87 will be deenergized whenever the actuator button for switch 170 is subject to the pressure of leaf arm 173, thus to open switch 170.

The direction of motor operation depends upon the position of the reversing switches 171, 172. Reversing switches 171, 172 are single pole, double throw switches interconnected by bridge 183 to function as a double pole, double throw switch. When the leaf arms 174, 175 are pressed against the button actuators for the switches 171, 172, the motor 87 will be conditioned to operate in a direction to advance the ram toward basket 42 when switch 170 is closed to energize the starting circuit. After the motor is up to speed and runs on its main winding 158 and centrifugal switch 97 opens, the reversing switches 171, 172 can be reversed in position without affecting the continued operation of the motor 87 to drive the ram downwardly. However, if in the course of such movement switch 170 is opened, thus to stop motor 87 and cause centrifugal switch 97 to close, and meanwhile reversing switches 171, 172 have been actuated, then the next actuation of leaf arm 173 to close switch 170 will start the motor in reverse, through its start winding 149, thus to withdraw the ram platen 47 toward the top of the housing 40.

The various instrumentalities which act upon the leaf blades 173, 174, 175 include a double armed blade actuator 178 directly responsive to the movement of the ram platen 47. One arm 179 of actuator 178 has a cam follower plate or lever 177. Arm 179 pivots about pintle 181 and carries a cam 182 adapted to press against a bridgeplate 183 which ties together the otherwise free ends of the leaf arms 174, 175 which actuate the reversing switches 171, 172. Accordingly, whenever the lever 177 is swung clockwise to its position shown in FIGS. 26 and 27, both leaf arms 174, 175 will press the spring biased actuator buttons of switches 171, 172 inwardly and switches 171, 172 will be actuated to reverse the polarity of the circuit to the start winding 149. Clock spring 184 about pintle 181 biases arm 179 and lever 177 counter clockwise toward its position shown in FIGS. 28 and 29. In this position the polarity of switches 171, 172 is reversed, as aforesaid.

Lever 177 is in the path of vertical movement of front cross member 81 of the extension linkage 46 for the ram platen 47. Accordingly, as illustrated in FIG. 5, when the extension linkage is in its fully retracted position at the top of the housing 40 lever 177 will be engaged by the cross member 81, thus to swing the lever 177 clockwise as shown in FIGS. 26, 27, and thus actuate the reversing switches 171, 172. However, when the extension linkages have dropped somewhat as a consequence of energization of the motor 87 to drive the ram downwardly, thus to relieve the pressure of the cross member 81 from the lever 177, the clock spring 184 will swing the lever 177 to its position shown in FIGS. 28 and 29 and switches 171, 172 will reverse polarity.

Arm 179 carries a second swing arm or lever 185 swingable about the same pintle 181 and also subject to the pressure of clock spring 184, and which is further subject to the opposite pressure of a compression coil spring 186 between lever 177 and plate 206 to bias arm 185 away from lever 177 and toward a stop tab 187 (FIG. 28) formed on arm 179. Second arm 185 carries a cam 190 which will press against the uppermost leaf arm 173 which actuates motor start-stop switch 170. Accordingly, in the full line position of the ram and extension linkages 46 shown in FIG. 5, the actuation of cam lever 177 by the ram cross piece 81 will not only actuate the reversing switch leaf arms 174, 175 but will also actuate the start-stop switch leaf arm 173, as is illustrated in FIG. 26. In this position of the parts lever arm 185 is subject to being moved counter clockwise away from pressure engagement with leaf arm 173 against the bias of its spring 186.

Because of the foregoing structure, the start-stop switch 170 will be actuated into open position every time the ram assembly moves upwardly into its completely retracted position, thus to stop motor 87 at the conclusion of the compacting cycle.

Leaf arm 173 for start-stop switch 170 also responds to manual control movement of the single control lever 134 and its arm 166. As indicated in FIG. 25, control bell crank 191 is pivotally mounted on pintle 192. While in this view bell crank 191 is illustrated (for clarity of presentation) in spaced relation to other parts, it actually occupies a position indicated by the dotted lines in which it is in face contact with a swing bracket 193, also pivoted about pintle 192.

Bracket 193 has a depending arm 194 and a peg 195 depending therefrom and which functions as a cam follower which rides on a cam surface 196 of the annular bracket 165 formed on the inner end of arm 166 and which is rotated thereby.

Bracket 193 has a depending lever 197, the end of which is provided with a tab 200 which hooks around leaf arm 173 as shown in FIG. 25. Clock spring 201 around pintle 192 biases bracket 193 in a clockwise direction, as viewed in FIG. 25, thus to tend to draw leaf arm 173 to the right and actuate switch 170. Clockwise movement of the rotor bracket 165 however will cam its surface 196 against the peg 195 to rotate the bracket 193 counter clockwise, as shown in FIG. 25, and against the bias of spring 201, to relieve pressure of leaf blade 173 on the button actuator of switch 170 and permit the self-bias of the button actuator to open switch 170.

Figure 18:
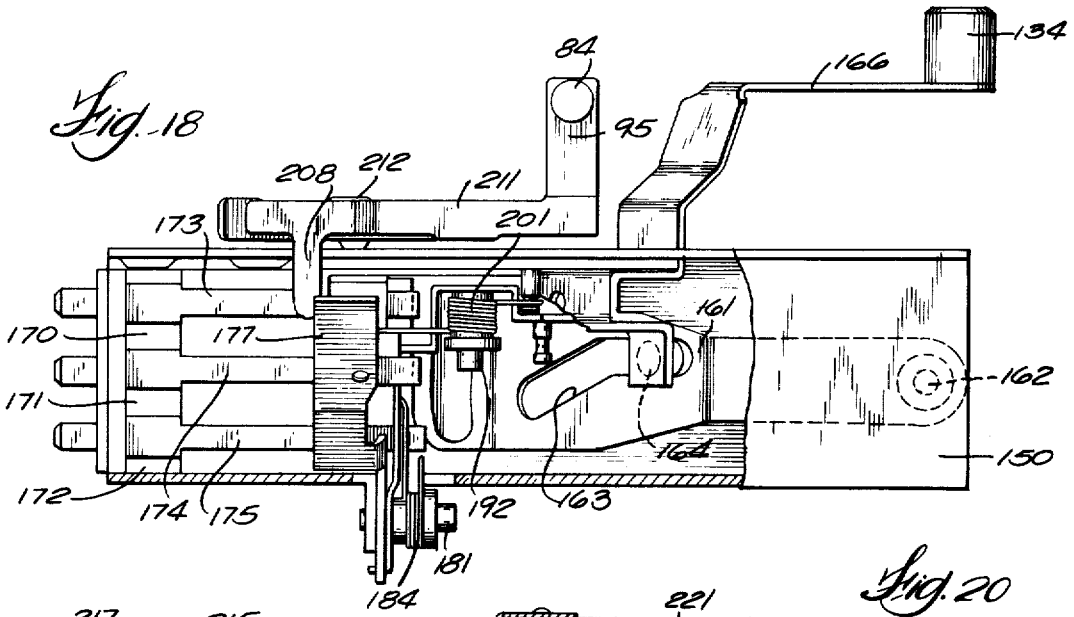
FIG. 18 is a rear view of the single lever control assembly.

Bell crank lever 191 has an input arm 202 which fits into a notch 203 of bracket 204 on arm 166 of single control lever 134 (FIG. 16). The output arm of bell crank lever 191 has a thrust edge 205 adapted to engage the upstanding plate 206 of lever 185 (FIG. 25). Offset rearwardly from thrust edge 205 is a second thrust edge 207 aligned to engage a downwardly extending tab 208 of lever 211 (FIGS. 18 and 25). Lever 211 has the upstanding actuating arm 95 which is engaged by the end of the lead screw 84 of the extension linkages 46, as hereinbefore described. Lever 211 is pivoted to the box 150 on a pintle 212 (FIGS. 16 and 18).

As indicated in FIG. 16, the end of spring 155 is connected to one end of lever 211 to bias it toward engagement of its tab 208 with leaf arm 173, thus to overcome the self-bias of the button actuator of switch 170 and actuate switch 170. However, lever 211 is normally inoperative to affect the position of leaf blade 173 because its actuating arm 95 is engaged by the end of lead screw 84 of the lazy tong linkage, thus to pivot the arm 211 about its pintle 212 a "neutral" position shown in FIGS. 16 and 25 in which tab 208 is spaced away from leaf blade 173 and has no effect thereon. It is only when the jam sensing feature of the compactor is active that lever arm 211 functions to actuate the leaf blade 173, as hereinafter described.

The operation of the manual control lever 134 and the inter-related switch actuating devices and the functioning of the switches will now be described in sequence with particular reference to the diagrammatic views of FIGS. 26 through 29 which illustrate the various steps.

FIG. 26 shows the various parts with the ram fully retracted and prior to starting the compacting cycle. All leaf arms 173, 174, 175 are cammed against the self-bias of the button actuators of switches 170, 171, 172 to actuate the switches 170, 171, 172 against their "normal" positions. Thus switch 170 is in its open position with motor 87 de-energized. To start the cycle, lever 134 is swung to the left, from broken to full line position shown in FIG. 16. Assuming the doors 53, 57 to be closed, thus to release the interlock 153 as hereinbefore described, lever 134 can swing to its extreme left position in which the bell crank 191 is actuated by pressure of the notch 203 in rotor 204 to swing the crank 191 about its pivot 192. This will force thrust edge 205 against the plate 206 of the lever 185 and force the lever 185 to its position shown in FIG. 27 in which spring 186 is compressed and the lever 185 has moved far enough counter clockwise in this figure to relieve pressure against the leaf arm 173 so that the self-bias of button actuator for switch 170 will move the start-stop switch 170 to its normally closed position. This will start the motor 87 and the ram will be actuated to advance toward the basket 42.

As illustrated in FIG. 28, as soon as the cross member 81 on the extension linkage has descended it will release lever 177 and clock spring 184 will swing leaf actuator 178 counter clockwise and relieve the pressure of cam 182 on the reversing leaf arms 174, 175. The reversing switches 171, 172 will thus reverse polarity to condition the motor to operate in reverse, the next time the motor is started.

FIG. 28 illustrates the position of parts when the operator stops the cycle prior to completion thereof. Control lever 134 is swung to the right (FIG. 16) from its "start" toward its "off" position. Movement of the arm 166 of lever 134 slightly beyond its center position will allow the cam follower peg 195 (FIG. 25) to ride along the cam surface 196 of rotor 165, thus permitting clock spring 208 which engages the rotor bracket 193 to pivot the rotor bracket clockwise in this view, thus drawing tab 200 against the leaf blade 173 and forcing it against the self-bias of the button actuator on switch 170, as illustrated in FIG. 28, to open switch 170. Motor 87 will now stop. If lever 134 is now again turned to its "start" position, thus to cam tab 200 away from leaf arm 173, the self-bias of the button actuator for switch 170 will reclose this switch and start the motor, but this time in reverse direction, because the switches 171, 172 have previously changed polarity as a consequence of the extension linkage having moved from retracted position.

The ram will now move upwardly to its completely retracted position. As soon as the ram reaches uppermost position, as indicated in FIG. 26, the leaf arm 173 will open switch 170 under pressure of the extension linkage cross member 81 against the lever 177, thus to stop the motor.

Access can then be had to the interior of the compactor housing by swinging lever 134 to its "off" position. In the course of thus swinging the lever, leaf blade 173 will not be reactuated because it is already in FIG. 26 position because of the pressure of ram member 81. Movement of the lever to its "off" position will unlatch the doors 53, 57 by withdrawing latch arm 160 (FIG. 19) and permit the doors to be opened.

FIG. 29 illustrates a situation similar to that shown in FIG. 28, in that the motor 87 is stopped, but in which instead of stopping the motor 87 by manually manipulating the lever 13, it is stopped because a jam is sensed. If some hard object becomes lodged between the front of the basket 42 and the ram platen 47, the rubber elements 116, 92 shown in FIG. 5 will yield rearwardly and the lead screw 84 will retract slightly rearwardly in the housing, thus to take the pressure of its end button 94 off of the actuator arm 95 of lever 191. When this happens, the lever 211 will swing about its pintle 212 (FIG. 16) under the pressure of spring 155, thus to force tab 208 against the leaf blade 173 and actuate switch 170 to stop the motor 87.

The operator may now re-start the motor by swinging the lever 134 to the left (clockwise in FIG. 16). This will swing the bell crank 191 counter clockwise about its pintle 192 (FIGS. 16 and 25) and press its cam edge 207 against the tab 208 to take the tab pressure off of the leaf blade 173 so that the self-bias of button actuator for switch 170 will close switch 170, thus starting the motor. However, because the reversing switches 171, 172 had been previously actuated as aforestated, the motor will now operate in reverse to withdraw the ram platen from the basket. When the ram is completely withdrawn and the motor is stopped as a consequence of actuation of switch 170 when ram cross member 81 engages lever arm 177, the operator can open the doors and reach in to remove or rearrange object which caused the jam and start a fresh compacting cycle.

As previously explained, there is also a safety switch 129 which is closed when the basket 42 is completely seated in the housing 40. As shown in FIG. 30, this switch 129 is in series with the motor 87. Accordingly, if the basket is not seated in position switch 129 will not be closed and the electrical circuit is interlocked against operation.

As previously explained and as indicated in FIG. 30, the motor 87 is also provided with a centrifugally actuated switch 97. Accordingly, when the motor is subjected to loads which tend to slow it below running speed, switch 97 will close. The motor will slow down as it is compressing trash in basket 42 and as the resistance to ram movement builds up.

Moreover, if there is no trash in the basket, centrifugal switch 97 will nevertheless operate as the extension linkages reach their maximum extension and spring 96 (FIG. 7) imposes stalling loads on the motor 87.

Switch 97 will function after the reversing switches 171, 172 have been previously actuated, as a consequence of the movement of the ram cross member 81 away from lever 177, so that the operation of switch 97 will cause reversal of the motor and withdraw the ram from the basket.

Figure 20:
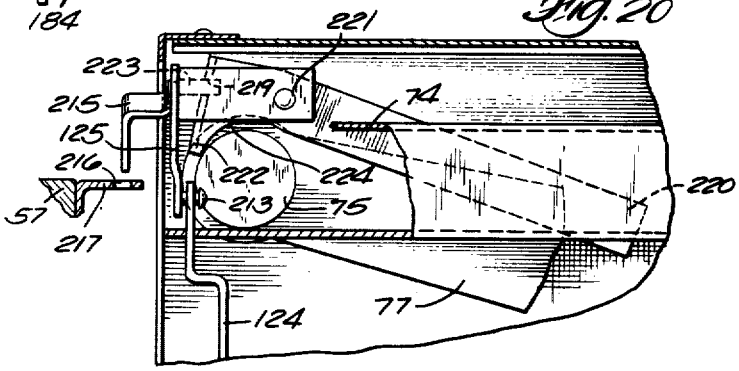
FIG. 20 is a fragmentary cross section taken along the line 20—20 of FIG. 10.
Figure 21:
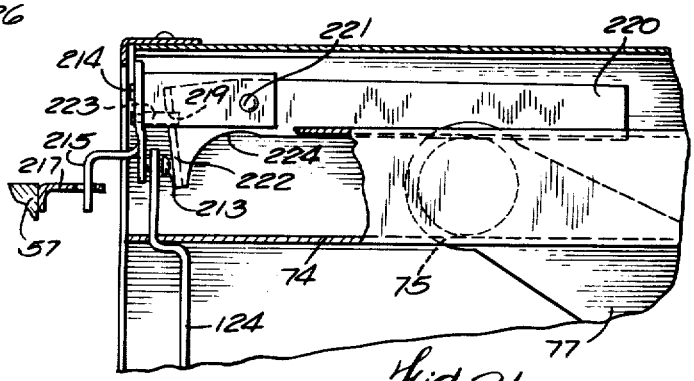
FIG. 21 is a fragmentary cross section similar to FIG. 20, but showing a different position of the parts.

The latch slide bar 124 shown in FIGS. 10, 13 and 14 is actuated by the crank 125 by the mechanism shown in FIGS. 10, 20 and 21. Latch bar 124 is connected by pintle 213 to the crank 125 which pivots on pintle 214. The other end of crank 125 is provided with latch finger 215 which engages into a latch opening 216 in the top flange 217 of loading door 57 (FIGS. 19, 20, 21). Latch finger 215 supplements door latch finger 160 hereinbefore described.

Crank 125 is caused to pivot about its pintle 214 by ram movement. One of the rollers 75 for the uppermost linkages 77 of the extension linkages 46 is aligned to actuate a cam follower arm 220 (FIGS. 20, 21) which is pivoted to housing 40 on pintle 221. Cam follower arm 220 has an end flange 222 with a hole 219 in which the cam follower pin 223 rides. Arm 220 is provided with a curved end portion 224 against which the roller 75 presses when the extension linkage 46 is in its completely retracted position, as shown in FIG. 20. In this position the cam follower lever 220 is tilted as illustrated to swing crank arm 125 clockwise about its pintle 214 as viewed in FIG. 10, thus to lift latch finger 215 out of the door flange opening 216. At the same time slide bar 124 is displaced downwardly to release the engagement of the cams 126 from the headed pins 121 on the service door 53. Accordingly, all doors are released and the doors may be opened for removing the basket, feeding trash thereinto, etc.

However, during the compaction cycle, as soon as the ram moves downwardly, the roller 75 moves to its position shown in FIG. 21 in which the cam follower arm 220 is lifted, thus pivoting about pintle 221, swinging crank arm 125 counter clockwise as viewed in FIG. 10, engaging latch 215 with the loading door 57 and lifting the latch bar 124 to engage the cams 126 with the headed pins 121 on the service door 53, thus positively locking the doors 53, 57 and insuring ample front support for the basket 42, as is shown in FIG. 5.

Figure 22:
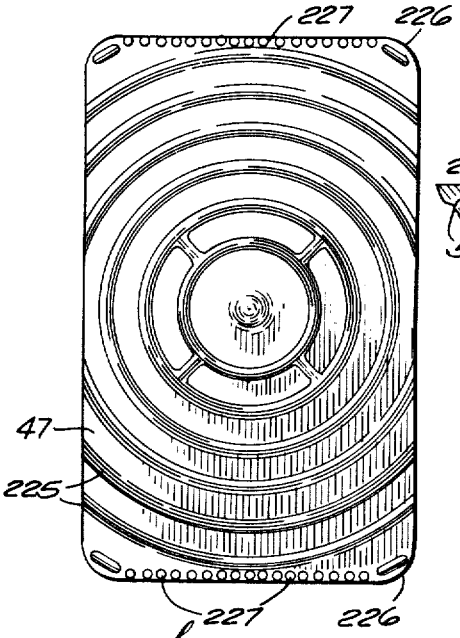
FIG. 22 is a face view of the undersurface of the pressure platen.

The bottom of the pressure platen 47 is desirably provided with a concentric series of ribs 225 (FIGS. 5, 22). These ribs concentrate pressure on frangible trash, such as bottles, to promote shattering of the bottles in the compactor, thus to reduce the volume which these bottles would otherwise occupy.

The fore and aft edges 226 of the platen 47 are desirably provided with projections 227 which engage and score frangible trash at the edges of the basket, to promote shattering thereof.

The concentric rib series 225 is the preferred pattern, because one or another of the ribs will likely contact an item of frangible trash, such as a bottle, regardless of its orientation in the basket.

Figure 31:
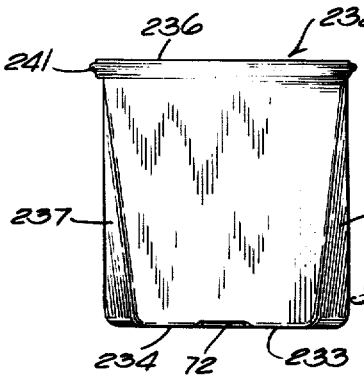
FIG. 31 is an end view of a modified trash basket.
Figure 32:
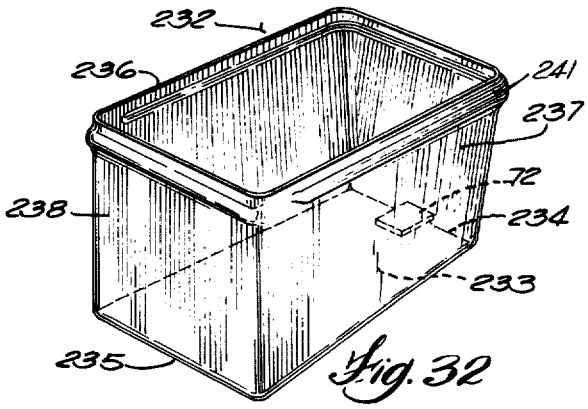
FIG. 32 is a perspective view of the modified trash basket of FIG. 31.

FIGS. 31–32 illustrate a modified trash container or basket 232. This basket is made of the same plastic material as basket 42 and has flexible side walls which yield under ram pressure to seat against correspondingly shaped walls of the housing 40. However, in basket 232 the bottom wall 233 is rearwardly tapered so that the bottom rear corner 234 of the basket is somewhat narrower than the bottom front corner 235. The top rim 236 is rectangular in outline, whereas the bottom outline of the basket comprises a rearwardly tapering trapezoid. Rim 236 is desirably provided with an outwardly embossed rib 241 which fits into housing groove 71 (FIGS. 9 and 10) similar to rim 48 of basket 42. Bag 43 snubs about rib 241, as it does about rim 48. The side walls 237 of the basket converge downwardly and rearwardly. The supporting walls of the housing 40 are modified in shape to conform to basket 232, thus to provide a snug all around seat for the basket 232 when it is fully received therein. However, the downward and rearward taper of the basket is such as to predispose the basket to slide forward slightly in the event a hard object becomes jammed between the front wall of the basket and the ram platen 47.

In a practical embodiment of the invention in which there is approximately a ⅛ inch spacing between the flexible side walls 233 of the basket 232 and the supporting walls of the housing 40, and a ¼ inch spacing between the front wall 238 of the basket and the door wall 117, the basket 232 will slide forwardly about ¼ inch during a jam. This is sufficient to relieve the pressure of switch actuator tab 72 from basket switch 129 and thus stop motor 87 in the event of a jam. In this embodiment it is unnecessary to provide the jam sensing mechanism hereinbefore described in which the entire ram assembly yields rearwardly slightly in the event of a jam and in which the tab 208 on the lever 211 actuates leaf blade 173. In this modified embodiment, the jam responsive switch actuating mechanism aforesaid can be omitted in favor of stopping the motor by relieving the pressure of actuator tab 72 on the basket safety switch 129.

A re-set button can be located near the bottom of the compactor frame to permit the operator to re-start the motor which will then return to its uppermost position and actuate the various mechanisms which unlatch the door, etc., so that the operator can then open the door and relieve the jam.

The tapered or wedge configuration of basket 232 has the further advantage that it may be easily removed from its seat in the compactor after it has been filled with trash. During the compacting procedure the flexible walls of the basket flex against the supporting frame. When the basket is filled and it is desired to remove the same from the housing, a slight forward movement of the basket will quickly relieve the pressure engagement of its flexible walls with the corresponding tapered supporting walls of the housing and relieve all binding therebetween.

In preferred embodiments of the invention the basket 42, 232 is made of polyethylene plastic which is sanitized with a bactericide molded into the plastic. The bags 43 are likewise santized.

Figure 23:
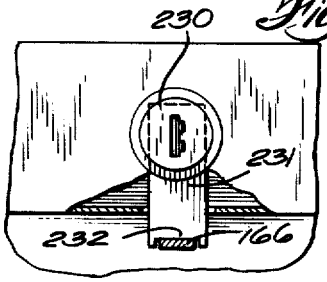
FIG. 23 is a fragmentary view illustrating the operation of the key lock.

A key lock 230 is also provided. As shown in FIGS. 9 and 23, it actuates a vertically reciprocating plunger 231 which has a socket 232. The key lock has two modes of use. In its first mode, when the lever is in its right hand or "off" position (FIG. 9) actuation of the lock will advance the plunger downwardly into the path of swinging movement of the lever 134, thus to block movement of the lever toward start position. With the lever 134 at the right of center, latch 160 is in raised position and both doors 53, 57 are free to be opened, thus permitting loading and unloading the basket, but precluding operation of the compactor.

In its second mode, the lever is placed in its center position (FIG. 23). Actuation of the lock will advance its plunger 231 to engage its socket 232 over the arm 166 of the lever 134. In this position of the lever 134 latch 160 is also advanced to lock both doors 53, 57 in closed position. Starting of the compactor is also precluded. In this mode small children can neither gain access to the interior of the housing nor start the compactor.

We claim:

1. A trash compactor having a housing with unitary frame and body, said housing having panel surfaces with side margins turned at a right angle to form edge flanges, and transverse panel walls having margins in face contact with said flanges and fastened thereto, edge portions of said transverse panel walls being bent at a right angle to form flanges parallel to the first-named panel surfaces to form box section corner posts for the housing.

2. The invention of claim 1 in which one of the transverse panel walls has an opening defining a door opening to admit a container into the interior of the housing.

3. The invention of claim 2 in which another of the transverse panel walls has an opening to facilitate removal of the ram through the rear of the housing.

* * * * *